US010394157B2

(12) United States Patent
Ishida

(10) Patent No.: US 10,394,157 B2
(45) Date of Patent: Aug. 27, 2019

(54) IMAGE FORMING APPARATUS

(71) Applicant: KONICA MINOLTA, INC., Tokyo (JP)

(72) Inventor: Hirofumi Ishida, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/013,477

(22) Filed: Jun. 20, 2018

(65) Prior Publication Data

US 2018/0373177 A1 Dec. 27, 2018

(30) Foreign Application Priority Data

Jun. 21, 2017 (JP) ..... 2017-121383

(51) Int. Cl.

| | |
|---|---|
| ***G03G 15/00*** | (2006.01) |
| ***G03G 15/02*** | (2006.01) |
| ***G03G 15/08*** | (2006.01) |
| ***G03G 15/01*** | (2006.01) |

(52) U.S. Cl.

CPC ..... *G03G 15/0275* (2013.01); *G03G 15/0136* (2013.01); *G03G 15/087* (2013.01); *G03G 15/5008* (2013.01); *G03G 15/6511* (2013.01); *G03G 15/6555* (2013.01)

(58) Field of Classification Search

USPC ..... 399/134, 167, 297–299, 302, 303, 308

See application file for complete search history.

(56) References Cited

U.S. PATENT DOCUMENTS 6,738,594 B2 * 5/2004 Nakagawa ..... G03G 15/0194 399/299

7,239,829 B2 * 7/2007 Tanaka ..... G03G 15/50 399/167

FOREIGN PATENT DOCUMENTS

JP H-04-350672 12/1992

* cited by examiner

*Primary Examiner* — Hoan H Tran

(74) *Attorney, Agent, or Firm* — Buchanan Ingersoll & Rooney PC

(57) ABSTRACT

An image forming apparatus includes: a first photoconductor and a second photoconductor; an image carrier onto which a toner image formed on the first photoconductor and a toner image formed on the second photoconductor are transferred; and a controller that, when the toner image formed on the first photoconductor is transferred onto the image carrier, rotates the second photoconductor while keeping the second photoconductor spaced apart from the image carrier.

10 Claims, 5 Drawing Sheets

FIG.9

<table>
<tr><th colspan="2">IMAGE FORMATION CONDITIONS</th><th colspan="3">SLIGHT ROTATION CONDITIONS</th></tr>
<tr><th>ABSOLUTE HUMIDITY X [g/m$^3$]</th><th>BELT SPEED [mm/s]</th><th>INTERVAL [NUMBER OF SHEETS OF PAPER]</th><th>SPEED [mm/s]</th><th>ROTATION TIME PERIOD [ms]</th></tr>
<tr><td rowspan="2">10<X≤16</td><td>100</td><td rowspan="4">50</td><td rowspan="2">100</td><td rowspan="6">100</td></tr>
<tr><td>200</td></tr>
<tr><td rowspan="2">16<X≤24</td><td>100</td></tr>
<tr><td>200</td><td rowspan="4">200</td></tr>
<tr><td rowspan="2">24<X≤28</td><td>100</td><td rowspan="2">30</td></tr>
<tr><td>200</td></tr>
<tr><td rowspan="2">28<X</td><td>100</td><td>20</td></tr>
<tr><td>200</td><td>10</td></tr>
</table>

IMAGE FORMING APPARATUS

The entire disclosure of Japanese Patent Application No. 2017-121383, filed on Jun. 21, 2017, is incorporated herein by reference in its entirety.

BACKGROUND

Technological Field

The present invention relates to an image forming apparatus.

Description of the Related Art

Japanese Laid-Open Patent Publication No. 04-350672 discloses an image forming apparatus including means for slightly rotating a photoconductor (a photoconductor drum) at prescribed time intervals when no image is formed. By slightly rotating the photoconductor after a lapse of a certain time period since rotation of the photoconductor has been stopped, the surface portion of the photoconductor, which faces a charging unit, is prevented from remaining at the same position for a long time period. The above-mentioned publication discloses that, according to such a configuration, formation of a so-called pause memory on the photoconductor can be suppressed, so that occurrence of charging unevenness can be suppressed.

SUMMARY

In an image forming apparatus including an intermediate transfer belt and a plurality of photoconductors, by way of example, monochrome printing and color printing are performed. When monochrome printing is performed, the photoconductor for monochrome printing contacts the intermediate transfer belt while the plurality of photoconductors for color printing are spaced apart from the intermediate transfer belt. When color printing is started after monochrome printing is continuously performed, the plurality of photoconductors for color printing, which are spaced apart from the intermediate transfer belt, are brought into contact with the intermediate transfer belt. When color printing is performed in this state (particularly when color printing is performed after monochrome printing is continuously performed under an image formation condition of a high humidity environment), a dark CD streak (a streak extending in the longitudinal direction of the photoconductor) may be formed on a sheet of paper subjected to color printing in a cycle corresponding to the rotation cycle of each photoconductor for color printing.

As the number of sheets of paper on which monochrome printing is continuously performed is larger, that is, as the time period becomes longer, during which monochrome printing is continuously performed in the state where the photoconductors for color printing are spaced apart from the intermediate transfer belt, the CD streak is more likely to be darkened, which is formed on a sheet of paper by performing color printing after performing monochrome printing. Such a CD streak hardly occurs merely when photoconductors for color printing are left to stand in a high humidity environment. Such a CD streak is formed to be darkest when color printing is performed immediately after monochrome printing is continuously performed in the state where the photoconductors for color printing are spaced apart from the intermediate transfer belt. Then, as time passes (as the number of sheets of paper for color printing is increased), the CD streak to be formed on the sheet of paper gradually becomes lighter.

It is presumed that the above-described situation is caused by the following reasons. Specifically, a photoconductor unit includes a waste toner collection unit disposed so as to contact the surface of the photoconductor. The waste toner collection unit includes: a housing having an opening and configured to house waste toner therein; a sealing member disposed between the surface of the photoconductor and an upstream portion of the opening of the housing; and a cleaning blade disposed between the surface of the photoconductor and a downstream portion of the opening of the housing. The housing has an inner area (an area in which waste toner is housed) that forms a space approximately hermetically sealed by the surface of the photoconductor, the sealing member and the cleaning blade.

When monochrome printing is continuously performed, each photoconductor for color printing is spaced apart from the intermediate transfer belt. When monochrome printing is continuously performed, the temperature in the interior space of the image forming apparatus rises. The interior space includes a portion in which the intermediate transfer belt is driven and rotationally moved. Air in the portion is moving, so that the temperature in the portion of the interior space is relatively less likely to rise. On the other hand, the photoconductor for color printing is spaced apart from the intermediate transfer belt. The housing of the waste toner collection unit is disposed to contact the surface of the photoconductor. The inner area, which is formed in the housing of the waste toner collection unit, is also included in the interior space of the image forming apparatus. The inner area (the inner area in which waste toner is housed) is approximately hermetically sealed by the surface of the photoconductor for color printing, the sealing member and the cleaning blade. Accordingly, the temperature in the inner area is more likely to rise as compared with the above-described space (the space in which the intermediate transfer belt is rotationally moved). In other words, when monochrome printing is continuously performed, a temperature difference is more likely to occur between the internal space and the external space of the housing of the waste toner collection unit that is disposed to contact the photoconductor for color printing that is disposed to be spaced apart from the intermediate transfer belt.

When the temperature difference occurs between the internal space and the external space of the housing of the waste toner collection unit, dew condensation is more likely to occur. When toner exists in a position between the surface of the photoconductor for color printing and the cleaning blade, or in a position between the surface of the photoconductor for color printing and the sealing member, toner absorbs moisture in accordance with dew condensation. A portion of the surface of the color photoconductor, which contacts the toner, also absorbs moisture. In the portion of the surface of the photoconductor, which partially absorbs moisture, a potential is less likely to be formed as compared with other portions. Thus, even when the surface of the photoconductor is charged by a charging unit, the potential becomes less uniform on a part of the surface of the photoconductor. When color printing is performed in this state, a dark CD streak (a streak extending in the longitudinal direction of the photoconductor) is to be formed on the sheet of paper subjected to color printing in a cycle corresponding to the rotation cycle of each photoconductor for color printing.

Japanese Laid-Open Patent Publication No. 04-350672 discloses a technical idea that a photoconductor is rotated at prescribed time intervals when no image is formed. This technical idea is intended to avoid that a surface portion of the photoconductor, which faces the charging unit, remains at the same position for a long time period, but not intended to, for example, suppress formation of a CD streak on a sheet of paper when color printing is performed after monochrome printing is continuously performed.

The present invention has been made in light of the above-described circumstances. An object of the present invention is to provide an image forming apparatus having a configuration capable of suppressing partial absorption of moisture by a photoconductor that is spaced apart from an image carrier such as an intermediate transfer belt, thereby suppressing formation of a CD streak on a medium such as a sheet of paper when printing is performed using this photoconductor.

To achieve at least one of the abovementioned objects, according to an aspect of the present invention, an image forming apparatus reflecting one aspect of the present invention comprises: a first photoconductor and a second photoconductor that are disposed to be spaced apart from each other; a first image forming unit that forms a toner image on the first photoconductor; a second image forming unit that forms a toner image on the second photoconductor; an image carrier onto which the toner image formed on the first photoconductor and the toner image formed on the second photoconductor are transferred; and a controller that, when the toner image formed on the first photoconductor is transferred onto the image carrier, rotates the second photoconductor while keeping the second photoconductor spaced apart from the image carrier.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 9 is a diagram showing an example of a table about a slight rotation amount and the like, and an interval between slight rotations.

DETAILED DESCRIPTION OF EMBODIMENTS

Hereinafter, one or more embodiments of the present invention will be described with reference to the drawings. However, the scope of the invention is not limited to the disclosed embodiments.

(Image Forming Apparatus 100)

Figure 1:
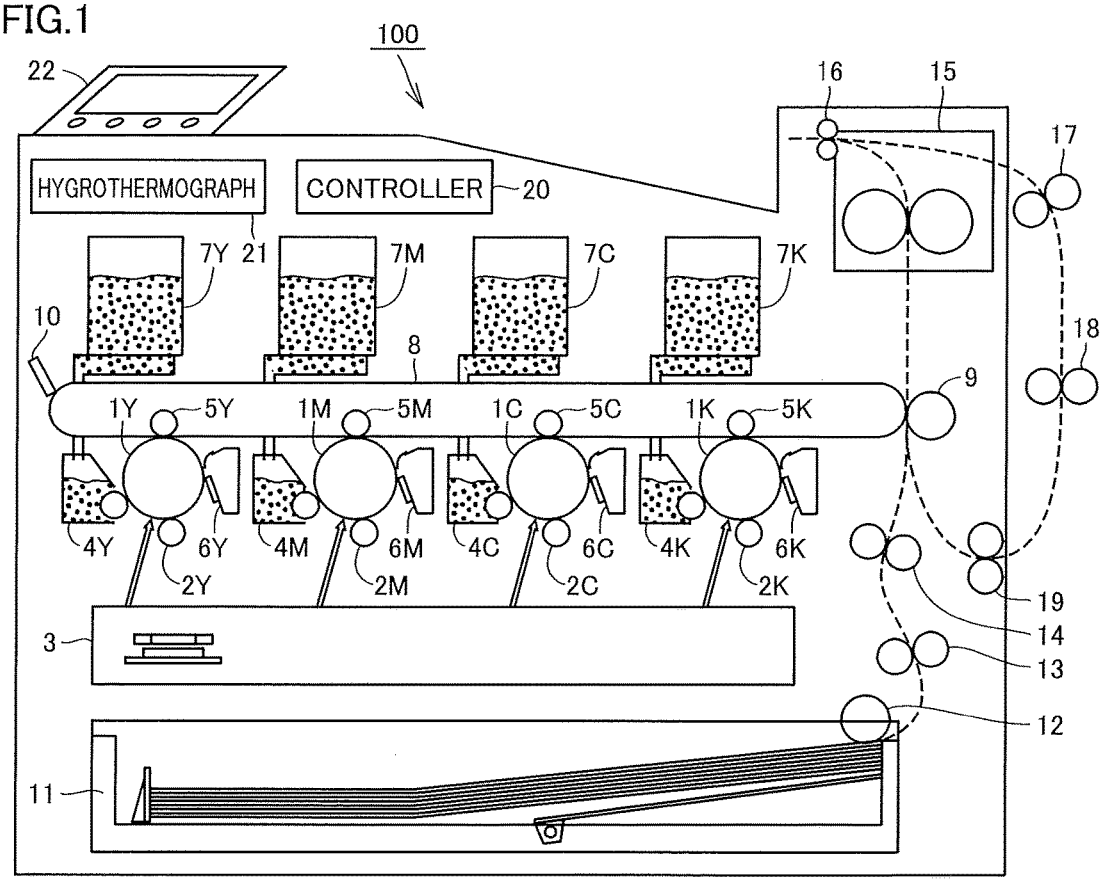
FIG. 1 is a diagram schematically showing an image forming apparatus 100 according to an embodiment.

FIG. 1 is a diagram schematically showing an image forming apparatus 100 according to an embodiment. Image forming apparatus 100, which employs an electrophotographic system, is configured to form an image on a recording medium such as a sheet of paper based on an input image signal. Image forming apparatus 100 includes a controller 20. Controller 20 includes a CPU, a ROM, and a RAM. The CPU reads a program in accordance with the contents of processing from the ROM and develops the program onto the RAM, to control each of devices constituting image forming apparatus 100.

Image forming apparatus 100 includes an intermediate transfer belt 8 as an image carrier. Intermediate transfer belt 8 may be an image carrier (an intermediate transfer body) that is entirely formed in a shape of one roller. Below intermediate transfer belt 8, four photoconductors 1Y, 1M, 1C, and 1K corresponding to colors of yellow, magenta, cyan, and black, respectively, are arranged to be spaced apart from each other.

Charging units 2Y, 2M, 2C, and 2K, a laser unit 3, developing devices 4Y, 4M, 4C, and 4K, primary transfer rollers 5Y, 5M, 5C, and 5K, and waste toner collection units 6Y, 6M, 6C, and 6K are arranged sequentially around photoconductors 1Y, 1M, 1C, and 1K, respectively, so as to form a line in the rotation direction of their respective photoconductors. Toner bottles 7Y, 7M, 7C, and 7K are connected to developing devices 4Y, 4M, 4C, and 4K, respectively, serving as image forming units.

Primary transfer rollers 5Y, 5M, 5C, and 5K are arranged on the opposite side of photoconductors 1Y, 1M, 1C, and 1K, respectively, across intermediate transfer belt 8. Primary transfer rollers 5Y, 5M, 5C, and 5K are configured to be capable of moving relatively in the directions closer to and away from photoconductors 1Y, 1M, 1C, and 1K, respectively. For example, primary transfer rollers 5Y, 5M, 5C, and 5K move in the direction closer to intermediate transfer belt 8, which leads to a state where intermediate transfer belt 8 and each of photoconductors 1Y, 1M, 1C, and 1K are pressed into contact with each other. In this state, a primary transfer section is to be formed between intermediate transfer belt 8 and each of photoconductors 1Y, 1M, 1C, and 1K.

Primary transfer rollers 5Y, 5M, 5C, and 5K move in the direction away from intermediate transfer belt 8, which leads to a state where intermediate transfer belt 8 is not pressed into contact with each of photoconductors 1Y, 1M, 1C, and 1K while each of photoconductors 1Y, 1M, 1C, and 1K is spaced apart from intermediate transfer belt 8. The technical meaning of this state will be described later. A secondary transfer roller 9 and a cleaning device 10 are arranged to contact intermediate transfer belt 8. A secondary transfer section is formed between intermediate transfer belt 8 and secondary transfer roller 9. A fixing device 15 is disposed downstream of the secondary transfer section in the direction in which a sheet of paper is conveyed.

A hygrothermograph 21 is disposed inside image forming apparatus 100 and a display unit 22 is disposed on image forming apparatus 100. Hygrothermograph 21 measures the temperature and/or the humidity in the interior of image forming apparatus 100. Display unit 22 is formed of a touch panel, and configured to receive an input from a user. A paper feed cassette 11 is disposed in the lower portion of image forming apparatus 100. The sheets of paper housed inside paper feed cassette 11 are fed one by one into a paper conveying path in accordance with rotation of a conveying roller 12. Conveying roller pairs 13, 14, 16, 17, 18, and 19 are arranged in the paper conveying path.

(Color Printing)

When a color image signal is input into image forming apparatus 100 from an external device (for example, a personal computer, and the like), image forming apparatus 100 (controller 20) performs color conversion of this color image signal into yellow, magenta, cyan, and black, to produce a digital image signal. When laser unit 3 is driven based on the digital image signal, an electrostatic latent image corresponding to the digital image signal is formed on each of the surfaces of photoconductors 1Y, 1M, 1C, and 1K.

The electrostatic latent images formed on their respective photoconductors 1Y, 1M, 1C and 1K are developed by toners supplied from their respective developing devices 4Y, 4M, 4C, and 4K, to thereby form toner images of their respective colors. The toner images of respective colors are transferred onto intermediate transfer belt 8 so as to be superimposed on one another into one image on intermediate transfer belt 8 through the primary transfer section between intermediate transfer belt 8 and each of their respective primary transfer rollers 5Y, 5M, 5C, and 5K to which a transfer bias is applied. The toner remaining on each of photoconductors 1Y, 1M, 1C, and 1K after the primary transfer is collected by a corresponding one of waste toner collection units 6Y, 6M, 6C, and 6K.

The color toner image formed on intermediate transfer belt 8 is secondarily transferred onto a sheet of paper through the secondary transfer section between intermediate transfer belt 8 and a secondary transfer roller 9 to which a transfer bias is applied. The toner remaining on intermediate transfer belt 8 after the secondary transfer is collected by cleaning device 10. The toner image secondarily transferred onto the sheet of paper is heated and pressurized by fixing device 15, and thereby fixed onto the sheet of paper. The sheet of paper having the toner image fixed thereon is discharged through conveying roller pair 16 to the exterior of image forming apparatus 100.

When an image is formed also on the back side of the sheet of paper, the rotation of conveying roller pair 16 is reversed after the sheet of paper passes through fixing device 15. The sheet of paper is again conveyed to the secondary transfer section by conveying roller pairs 17, 18, and 19. After the back side of the sheet of paper is subjected to transferring and fixing similar to those in the above description, the sheet of paper is again flipped over as required such that its front and back sides are reversed, and discharged through conveying roller pair 16 to the exterior of image forming apparatus 100.

(Monochrome Printing)

When a monochrome image signal is input into image forming apparatus 100 from an external device (for example, a personal computer, and the like), image forming apparatus 100 (controller 20) brings about a state where primary transfer roller 5K is pressed into contact with photoconductor 1K (the first photoconductor) with intermediate transfer belt 8 interposed therebetween (or maintains this state), and also brings about a state where a linkage mechanism and the like coupled to primary transfer rollers 5Y, 5M, and 5C is driven to move primary transfer rollers 5Y, 5M, and 5C in the direction away from intermediate transfer belt 8, thereby causing photoconductors 1Y, 1M, and 1C (the second photoconductors) to be spaced apart from intermediate transfer belt 8. When laser unit 3 is driven based on the monochrome image signal, an electrostatic latent image corresponding to the monochrome image signal is formed on the surface of photoconductor 1K.

The electrostatic latent image formed on photoconductor 1K is developed by toner supplied from developing device 4K (the first image forming unit), to thereby form a toner image. The toner image is transferred onto intermediate transfer belt 8 through the primary transfer section between intermediate transfer belt 8 and primary transfer roller 5K to which a transfer bias is applied. The toner remaining on photoconductor 1K after the primary transfer is collected by waste toner collection unit 6K.

The toner image formed on intermediate transfer belt 8 is secondarily transferred onto a sheet of paper through the secondary transfer section between intermediate transfer belt 8 and secondary transfer roller 9 to which a transfer bias is applied. The toner remaining on intermediate transfer belt 8 after the secondary transfer is collected by cleaning device 10. The toner image secondarily transferred onto the sheet of paper is heated and pressurized by fixing device 15, and thereby fixed onto the sheet of paper. The sheet of paper having the toner image fixed thereon is discharged through conveying roller pair 16 to the exterior of image forming apparatus 100. As required, double-sided printing is performed by the same method as that in the above-described color printing.

(Waste Toner Collection Unit 6C)

Figure 2:
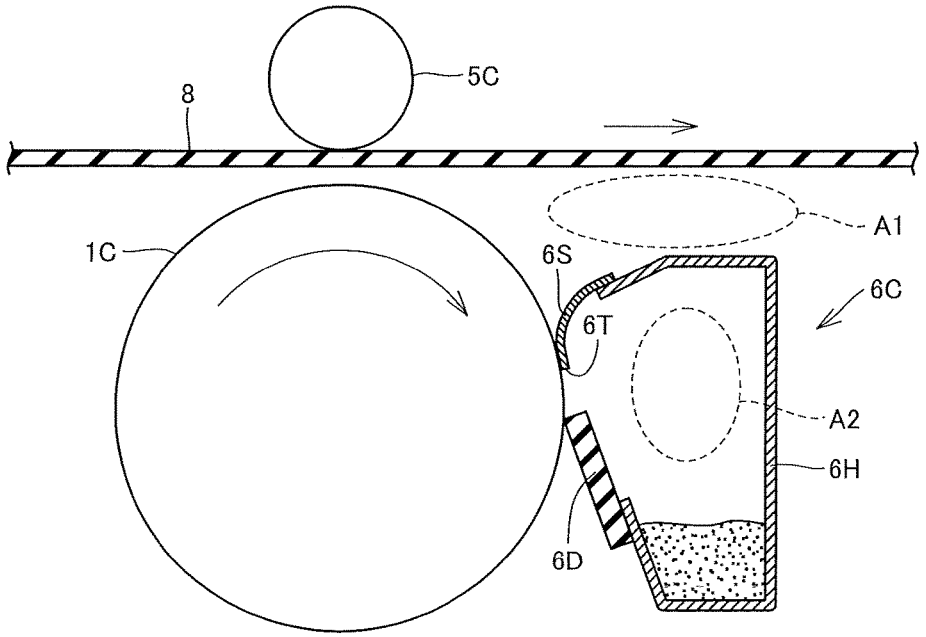
FIG. 2 is a diagram showing a state of each of an intermediate transfer belt 8, a photoconductor 1C, and a waste toner collection unit 6C during monochrome printing.

FIG. 2 is a diagram showing a state of each of intermediate transfer belt 8, photoconductor 1C, and waste toner collection unit 6C during monochrome printing. When monochrome printing is performed by photoconductor 1K (FIG. 1) as the first photoconductor, that is, when the toner image formed on photoconductor 1K is transferred onto intermediate transfer belt 8, photoconductor 1C as the second photoconductor is spaced apart from intermediate transfer belt 8. Waste toner collection unit 6C is disposed so as to contact the surface of photoconductor 1C. The same also applies to photoconductors 1Y and 1M and waste toner collection units 6Y and 6M, which are shown in FIG. 1.

Waste toner collection unit 6C includes a housing 6H, a sealing member 6S, and a cleaning blade 6D. Housing 6H has an opening and contains inside thereof the waste toner having remained on photoconductor 1C. Sealing member 6S is disposed between the surface of photoconductor 1C and an upstream portion of the opening of housing 6H. Cleaning blade 6D is disposed between the surface of photoconductor 1C and a downstream portion of the opening of housing 6H. On the inside of housing 6H (in an area in which waste toner is contained), a space A2 is provided, which is approximately hermetically sealed by the surface of photoconductor 1C, sealing member 6S and cleaning blade 6D, for preventing the waste toner inside housing 6H from leaking to a space A1 on the outside.

(Internal Temperature and External Temperature)

Figure 3:
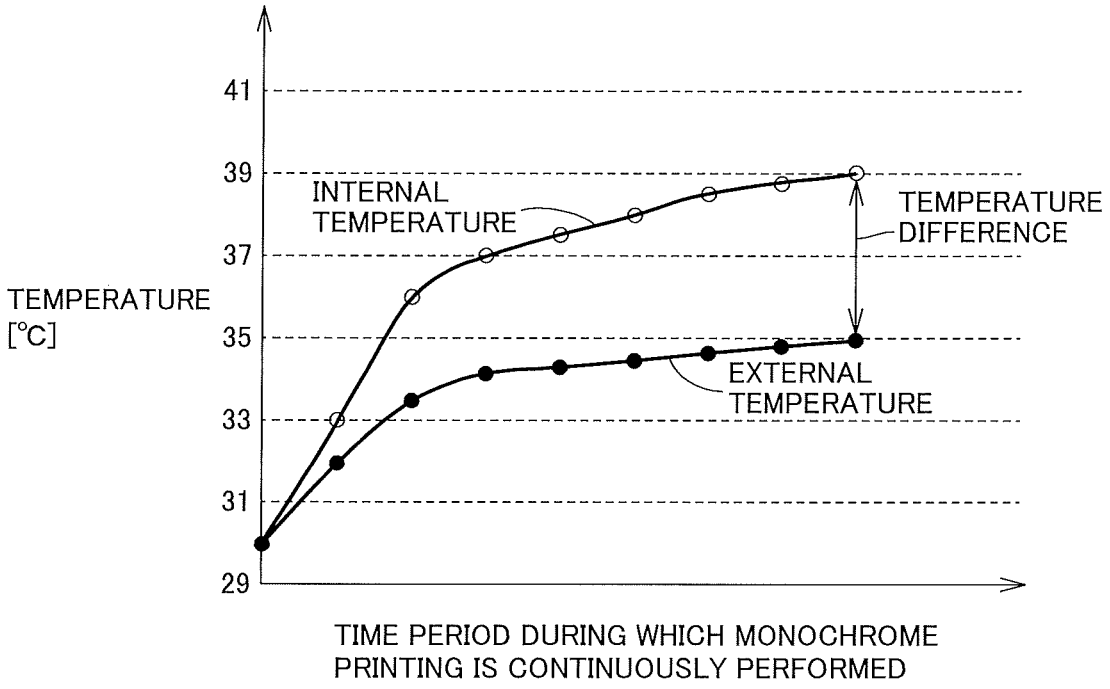
FIG. 3 shows a graph illustrating a relation among: a temperature in a space A2 inside a housing 6H approximately hermetically sealed by the surface of photoconductor 1C, a sealing member 6S and a cleaning blade 6D; a temperature in a space A1 outside space A2; and a time period during which monochrome printing is continuously performed.

FIG. 3 is a graph illustrating a relation among: a temperature in space A2 inside housing 6H approximately hermetically sealed by the surface of photoconductor 1C, sealing member 6S and cleaning blade 6D; a temperature in space A1 outside space A2 (that is, the temperature in the space outside housing 6H, more particularly, in the space in which intermediate transfer belt 8 is rotationally moved in the vicinity of housing 6H); and a time period during which monochrome printing is continuously performed.

Referring to FIGS. 2 and 3, when monochrome printing is continuously performed, the interior temperature of image forming apparatus 100 (FIG. 1) rises. Since space A2 (FIG. 2) inside housing 6H provided in waste toner collection unit 6C is hermetically sealed, the temperature in space A2 is relatively more likely to rise. On the other hand, in space A1 (FIG. 2) outside housing 6H of waste toner collection unit 6C, intermediate transfer belt 8 is driven and rotationally moved to generate airflow, so that the temperature in space A1 is relatively less likely to rise (that is, as compared with that of space A2).

When monochrome printing is continuously performed, a temperature difference is likely to occur between: space A2 inside housing 6H of waste toner collection unit 6C that is disposed to contact photoconductor 1C for color printing that is disposed to be spaced apart from intermediate transfer belt 8; and space A1 outside housing 6H. While photoconductor 1K is driven (while photoconductor 1C is not driven), airflow is generated in space A1 as a result of the rotational movement of intermediate transfer belt 8. This temperature difference occurs in accordance with generation of this airflow.

Even when the image formation condition is a high humidity environment, but when intermediate transfer belt 8 and photoconductor 1K are stopped, and photoconductor 1C and housing 6H are merely left to stand in the high humidity environment, a temperature difference hardly occurs. This temperature difference that may occur during driving of intermediate transfer belt 8 becomes smaller by exchange of the air in space A2 inside housing 6H with the air in space A1 outside housing 6H in a state where photoconductor 1C is rotationally driven as shown in FIG. 2 and the like (the details will be described later with reference to FIG. 5).

Figure 4:
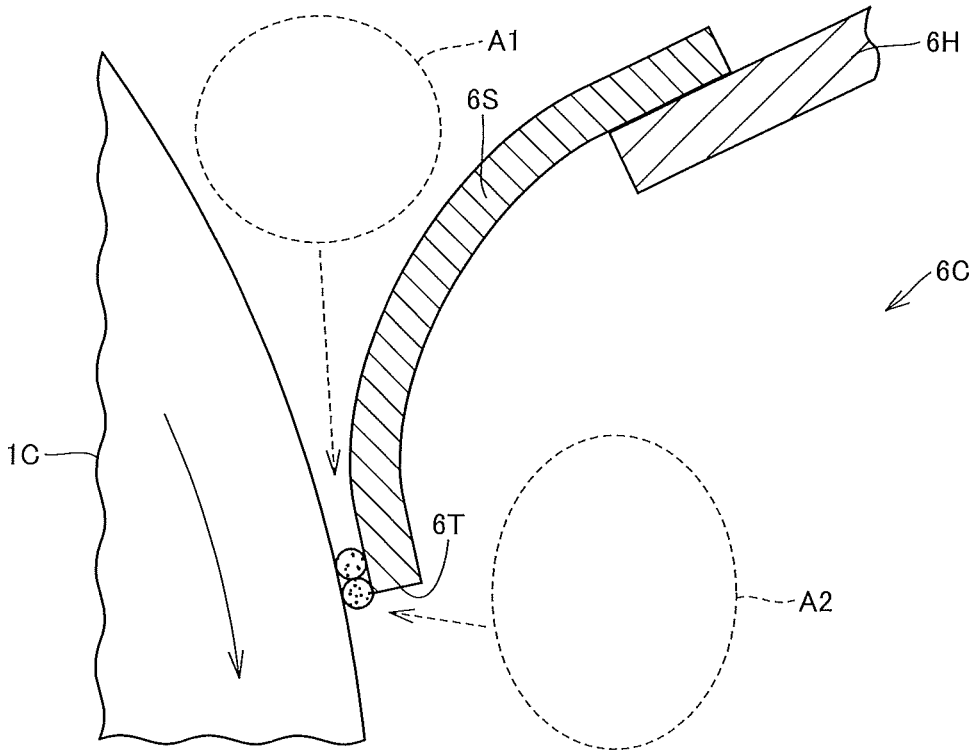
FIG. 4 is an enlarged view of a portion between the surface of photoconductor 1C and an end 6T of sealing member 6S.

FIG. 4 is an enlarged view of a portion between the surface of photoconductor 1C and an end 6T of sealing member 6S. The toner remaining on photoconductor 1C after the primary transfer is collected by waste toner collection unit 6C. A part of the toner may remain in a state where it is sandwiched between the surface of photoconductor 1C and end 6T of sealing member 6S. This occurs also in the position between the surface of photoconductor 1C and the end of cleaning blade 6D (FIG. 2).

When a temperature difference occurs between space A2 inside housing 6H of waste toner collection unit 6C and space A1 outside thereof, dew condensation is more likely to occur. When toner exists in the position between the surface of photoconductor 1C and end 6T of sealing member 6S, or in the position between the surface of photoconductor 1C and the end of cleaning blade 6D (FIG. 2), the toner absorbs moisture in accordance with occurrence of dew condensation. In accordance with moisture absorption of the toner, a portion of the surface of photoconductor 1C, which contacts the toner, also absorbs moisture.

A potential is less likely to be formed in the portion located in the surface of photoconductor 1C and partially absorbing moisture. Thus, even when the surface of photoconductor 1C is charged by charging unit 2C, the potential becomes less uniform on a part of the surface of photoconductor 1C. The same also applies to photoconductors 1Y and 1M. When color printing is performed in this state, a dark CD streak (a streak extending in the longitudinal direction of each of photoconductors 1Y, 1M, and 1C) is to be formed on a sheet of paper subjected to color printing in a cycle corresponding to the rotation cycle of the photoconductor for color printing (for example, photoconductors 1Y, 1M, and 1C).

Figure 5:
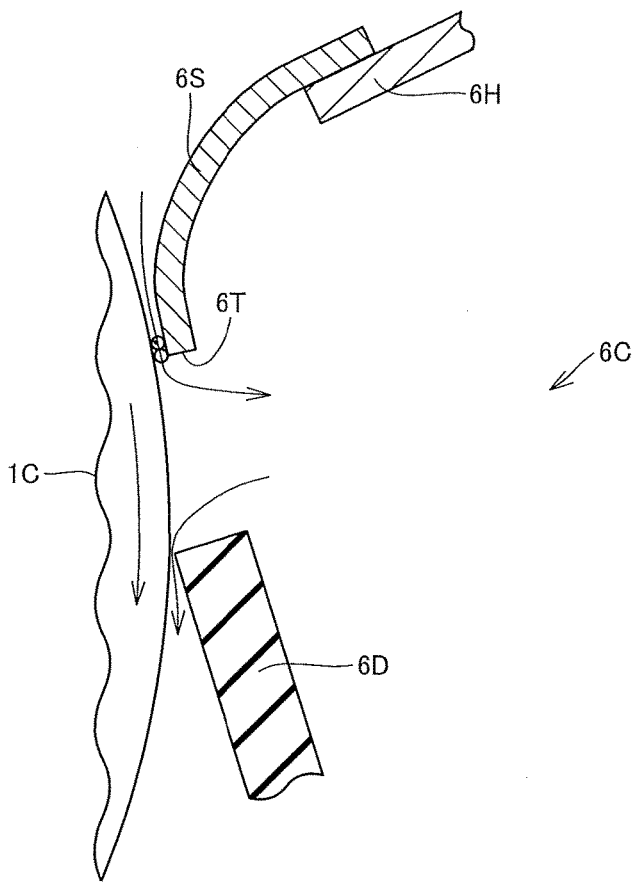
FIG. 5 is another enlarged view of the portion between the surface of photoconductor 1C and end 6T of sealing member 6S (a view showing a state where air is exchanged).

On the other hand, referring to FIG. 5, in image forming apparatus 100 of the present embodiment, when a monochrome image signal is input into image forming apparatus 100 from an external device (for example, a personal computer, and the like), formed is a state where photoconductors 1Y, 1M, and 1C (the second photoconductors) are spaced apart from intermediate transfer belt 8, and then, photoconductors 1Y, 1M, and 1C are rotated under the state where photoconductors 1Y, 1M, and 1C are spaced apart from intermediate transfer belt 8. By exchange of the air existing in the space inside housing 6H with the air in the space outside thereof, the temperature difference that may occur between these spaces becomes smaller.

Figure 6:
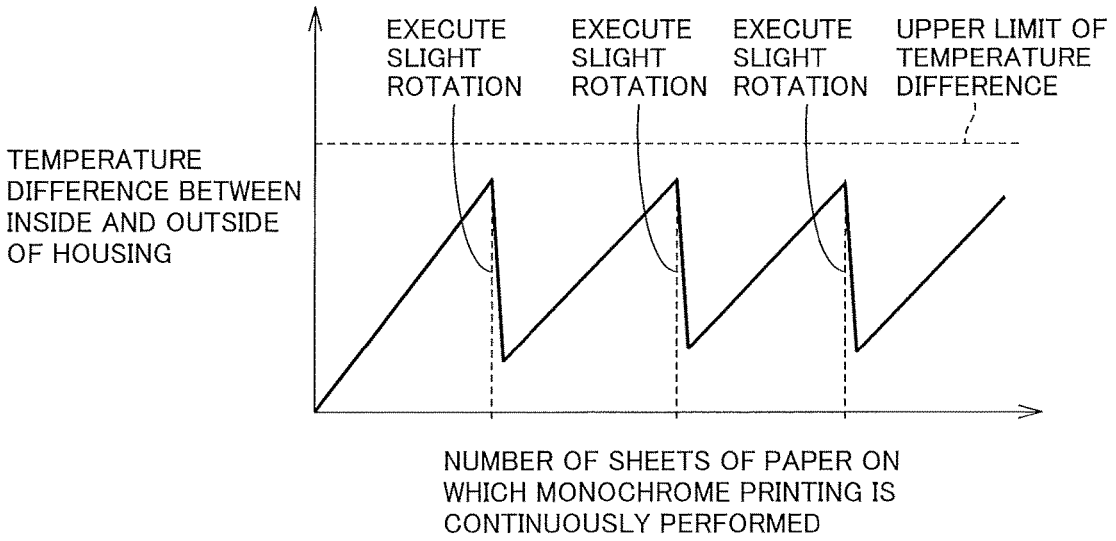
FIG. 6 is a diagram showing a relation between the number of sheets of paper on which monochrome printing is continuously performed and a temperature difference between the inside and the outside of housing 6H.

As shown in FIG. 6, when rotation of photoconductor 1C provided at waste toner collection unit 6C is kept stopped, the temperature difference between the internal space and the external space of housing 6H increases in accordance with increase in the number of sheets of paper on which monochrome printing is continuously performed. By rotating (slightly rotating) photoconductor 1C at a prescribed timing, the air existing in the internal space of housing 6H is exchanged with the air in the external space thereof, so that the temperature difference that may occur between these spaces becomes smaller. Consequently, the temperature difference can be set to a prescribed upper limit value (permissible value) or less.

Even if toner exists in the position between the surface of photoconductor 1C and end 6T of sealing member 6S, or in the position between the surface of photoconductor 1C and the end of cleaning blade 6D, moisture absorption of the toner can be suppressed, with the result that partial moisture absorption of the surface of photoconductor 1C that contacts the toner can also be suppressed. Even when color printing is performed after monochrome printing, the surfaces of photoconductors 1Y, 1M, and 1C can be uniformly charged, so that formation of a CD streak on the sheet of paper can be effectively suppressed.

Figure 7:
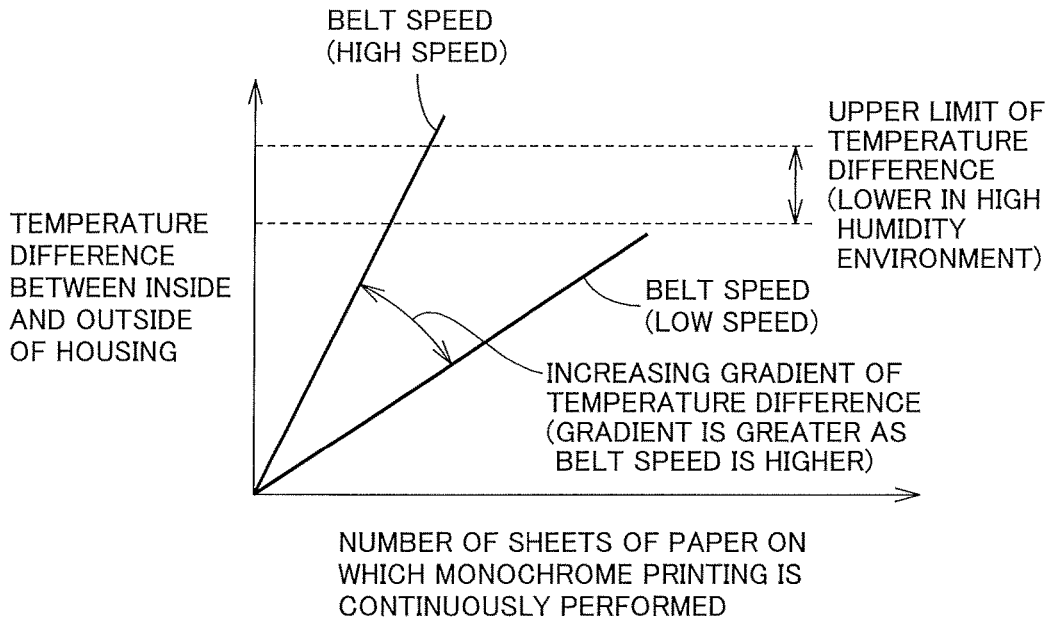
FIG. 7 is another diagram showing the relation between the number of sheets of paper on which monochrome printing is continuously performed and the temperature difference between the inside and the outside of housing 6H.

Referring to FIG. 7, when the temperature difference between the internal space and the external space of housing 6H is equal to or greater than a prescribed upper limit value, the surface of photoconductor 1C partially absorbs moisture due to occurrence of dew condensation. As the humidity in the environment in which image forming apparatus 100 is placed is higher, the temperature difference occurring during dew condensation becomes smaller, so that the upper limit of the temperature difference at which a CD streak is formed on the sheet of paper becomes lower. In a different point of view, as the moving speed of intermediate transfer belt 8 (the speed of intermediate transfer belt 8 printing onto the sheet of paper) is higher, the temperature in the external space of housing 6H is less likely to rise. Thus, the temperature difference is more likely to occur relative to the number of sheets of paper on which monochrome printing is continuously performed, so that a CD streak is more likely to be formed on the sheet of paper. The moving speed of intermediate transfer belt 8 (the speed of intermediate transfer belt 8 printing onto the sheet of paper) can be changed depending on whether printing is performed on plain paper or thick paper.

Figure 8:
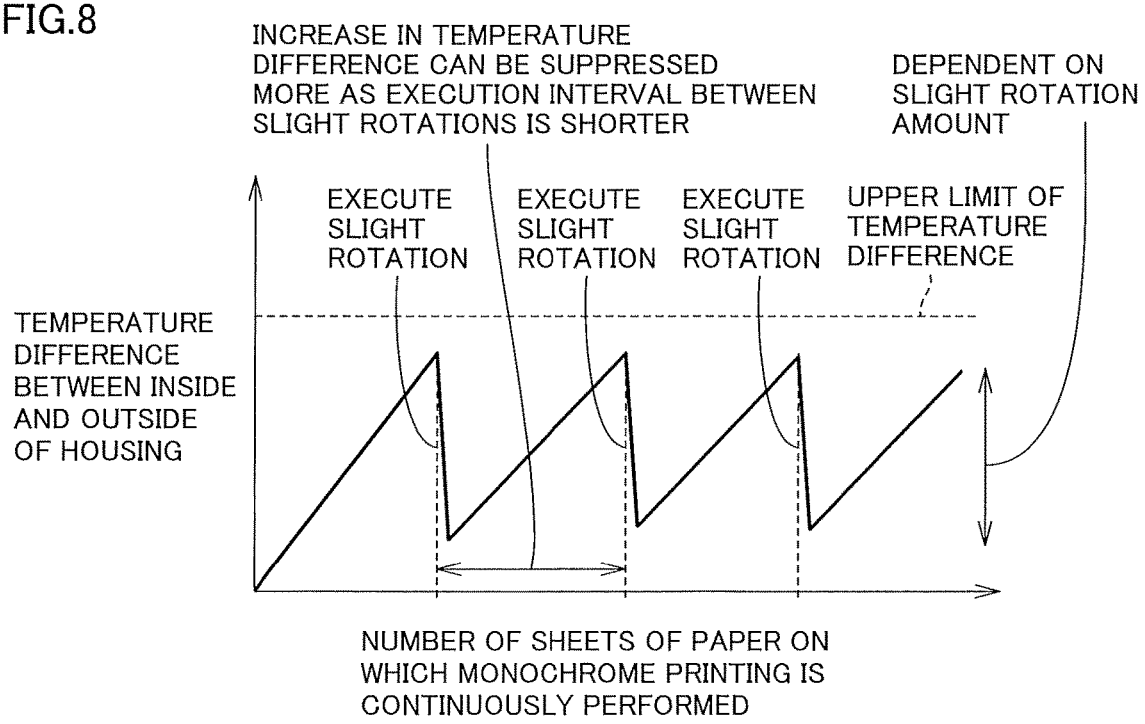
FIG. 8 is still another diagram showing the relation between the number of sheets of paper on which monochrome printing is continuously performed and the temperature difference between the inside and the outside of housing 6H.

Referring to FIG. 8, the following is an explanation about a relation among: the rotation amount during slight rotation of photoconductor 1C (the moving distance of the surface of photoconductor 1C in its rotation direction); the rotation speed during slight rotation of photoconductor 1C; and the interval between slight rotations of photoconductor 1C. The interval used herein means a value showing the number of sheets of paper on which monochrome printing is performed for each slight rotation. As the interval is shorter, the degree of increase in the temperature difference occurring during no slight rotation becomes smaller. As the rotation speed during slight rotation (the moving speed of the surface of photoconductor 1C) is higher, the amount of air exchanged between the inside and the outside of housing 6H is increased more. Thus, the temperature difference can be further reduced by one slight rotation. The same also applies to a case where the rotation amount during slight rotation (the moving distance of the surface of photoconductor 1C) is relatively large. The same also applies to a case where the time period during which slight rotation is performed (the rotation time period of photoconductor 1C) is relatively long.

On the other hand, by slight rotation, sealing member 6S and the surface of each of photoconductors 1Y, 1M and 1C are in sliding contact with each other, and cleaning blade 6D and the surface of each of photoconductors 1Y, 1M and 1C are in sliding contact with each other. As the values of the rotation speed, the rotation amount and the rotation time period during slight rotation are larger, the useful service life of each photoconductor may become shorter. As the interval between slight rotations is shorter, the useful service life of each photoconductor may become shorter. Accordingly, it is preferable that: on the image formation conditions by which a CD streak is less likely to occur (for example, in a low humidity environment), slight rotation is not performed, or these values of the rotation speed, the rotation amount and the rotation time period are decreased, or the interval is increased; and on the image formation conditions by which a CD streak is more likely to occur (for example, in a high humidity environment), slight rotation is performed, for example, to increase the values of the rotation speed, the rotation amount and the rotation time period, or to reduce the interval. It can be determined, for example, using hygrothermograph 21 (FIG. 1), controller 20 and the like provided in image forming apparatus 100, whether or not the current image formation condition falls into the one in which a CD streak is more likely to occur.

FIG. 9 shows an example of a table about a slight rotation amount and the like, and an interval between slight rotations. For example, when an absolute humidity X in the interior of image forming apparatus 100 (an absolute humidity in the space in which photoconductor 1C is disposed) is greater than 10 (g/m$^3$) and equal to or less than 16 (g/m$^3$), and when the moving speed of intermediate transfer belt 8 is 100 (mm/s) or 200 (mm/s), the interval between slight rotations can be set for each 50 sheets of paper on which monochrome printing is performed; the rotation speed of photoconductor 1C and the like during slight rotation can be set at 100 (mm/s); and the rotation time period of photoconductor 1C and the like during slight rotation can be set at 100 (ms).

For example, when absolute humidity X in the interior of image forming apparatus 100 is greater than 16 (g/m$^3$) and equal to or less than 24 (g/m$^3$), and when the moving speed of intermediate transfer belt 8 is 100 (mm/s), the interval between slight rotations can be set for each 50 sheets of paper on which monochrome printing is performed; the rotation speed of photoconductor 1C and the like during slight rotation can be set at 100 (mm/s), and the rotation time period of photoconductor 1C and the like during slight rotation can be set at 100 (ms).

Similarly, when absolute humidity X in the interior of image forming apparatus 100 is greater than 16 (g/m$^3$) and equal to or less than 24 (g/m$^3$), and when the moving speed of intermediate transfer belt 8 is 200 (mm/s), the interval between slight rotations can be set for each 50 sheets of paper on which monochrome printing is performed; the rotation speed of photoconductor 1C and the like during slight rotation can be set at 200 (mm/s); and the rotation time period of photoconductor 1C and the like during slight rotation can be set at 100 (ms).

For example, when absolute humidity X in the interior of image forming apparatus 100 is greater than 24 (g/m$^3$) and equal to or less than 28 (g/m$^3$), and when the moving speed of intermediate transfer belt 8 is 100 (mm/s) or 200 (mm/s), the interval between slight rotations can be set for each 30 sheets of paper on which monochrome printing is performed; the rotation speed of photoconductor 1C and the like during slight rotation can be set at 200 (mm/s); and the rotation time period of photoconductor 1C and the like during slight rotation can be set at 100 (ms).

For example, when absolute humidity X in the interior of image forming apparatus 100 is greater than 28 (g/m$^3$), and when the moving speed of intermediate transfer belt 8 is 100 (mm/s), the interval between slight rotations can be set for each 20 sheets of paper on which monochrome printing is performed; the rotation speed of photoconductor 1C and the like during slight rotation can be set at 200 (mm/s); and the rotation time period of photoconductor 1C and the like during slight rotation can be set at 100 (ms).

Similarly, when absolute humidity X in the interior of image forming apparatus 100 is greater than 28 (g/m$^3$), and when the moving speed of intermediate transfer belt 8 is 200 (mm/s), the interval between slight rotations can be set for each ten sheets of paper on which monochrome printing is performed; the rotation speed of photoconductor 1C and the like during slight rotation can be set at 200 (mm/s); and the rotation time period of photoconductor 1C and the like during slight rotation can be set at 100 (ms).

Without being limited to the above-described cases, the following configuration may be applied, for example, in which: the length of the rotation time period during slight rotation of photoconductor 1C and the like (the first rotation time period) is set at 200 (ms) when absolute humidity X in the interior of image forming apparatus 100 exceeds 28 (g/m$^3$); and the length of the rotation time period during slight rotation of photoconductor 1C and the like (the second rotation time period) is set at 100 (ms) when absolute humidity X in the interior of image forming apparatus 100 is equal to or less than 28 (g/m$^3$).

The above-described embodiments have been described based on the configuration in which photoconductors 1Y, 1M, and 1C for color printing are slightly rotated while being spaced apart from intermediate transfer belt 8 during monochrome printing. The technical idea disclosed in the above-described embodiments is not limited to such a configuration, but may be applicable to any color embodiment as long as an image forming apparatus includes at least a combination of intermediate transfer belt 8 (an image carrier) and the first and second photoconductors that are spaced apart from each other.

For example, the disclosed technical idea can be similarly applicable also to an image forming apparatus capable of performing printing using a combination of four colors of YMCK and special colors (clear toner, gold, silver, and the like). When photoconductors for special colors are stopped at a distance from intermediate transfer belt 8 during monochrome printing or during color printing in four colors of YMCK, the same moisture absorption as that described above may occur in the photoconductors for special colors. However, when the photoconductors for special colors are also similarly slightly rotated, occurrence of such a phenomenon can be effectively suppressed.

Although embodiments of the present invention have been described and illustrated in detail, the disclosed embodiments are made for purposes of illustration and example only and not limitation. The scope of the present invention should be interpreted by teens of the appended claims.

What is claimed is:

1. An image forming apparatus comprising:

a first photoconductor and a second photoconductor that are disposed to be spaced apart from each other;

a first image forming unit that forms a toner image on the first photoconductor;

a second image forming unit that forms a toner image on the second photoconductor;

an image carrier onto which the toner image formed on the first photoconductor and the toner image formed on the second photoconductor are transferred; and a controller that, when the toner image formed on the first photoconductor is transferred onto the image carrier, rotates the second photoconductor while keeping the second photoconductor spaced apart from the image carrier.

2. The image forming apparatus according to claim 1, further comprising:

a plurality of the second photoconductors spaced apart from each other; and a plurality of the second image forming units each forms a toner image on a corresponding one of the plurality of second photoconductors, wherein the controller, when the toner image formed on the first photoconductor is transferred onto the image carrier, rotates the plurality of the second photoconductors while keeping the plurality of the second photoconductors spaced apart from the image carrier.

3. The image forming apparatus according to claim 1, wherein the controller, when the second photoconductor is disposed to be spaced apart from the image carrier, selects in accordance with image formation conditions whether the second photoconductor is rotated or not.

4. The image forming apparatus according to claim 3, wherein the controller, when the second photoconductor is rotated while being spaced apart from the image carrier, sets a rotation amount of the second photoconductor in accordance with the image formation conditions.

5. The image forming apparatus according to claim 3, wherein the controller, when the second photoconductor is rotated while being spaced apart from the image carrier, sets a rotation speed of the second photoconductor in accordance with the image formation conditions.

6. The image forming apparatus according to claim 3, wherein the controller, when the second photoconductor is rotated while being spaced apart from the image carrier, sets a rotation time period of the second photoconductor in accordance with the image formation conditions.

7. The image forming apparatus according to claim 3, wherein the controller, when the second photoconductor is rotated while being spaced apart from the image carrier, sets an interval at which the second photoconductor is rotated in accordance with the image formation conditions.

8. The image forming apparatus according to claim 3, wherein the image formation conditions include an absolute humidity in a space in which the second photoconductor is disposed.

9. The image forming apparatus according to claim 8, wherein the second photoconductor is rotated by a length of a first rotation time period when the absolute humidity exceeds a prescribed value, and the second photoconductor is rotated by a length of a second rotation time period shorter than the first rotation time period when the absolute humidity is equal to or less than the prescribed value.

10. The image forming apparatus according to claim 3, wherein the image formation conditions include a printing speed of the image carrier.

* * * * *